US007712622B2

(12) United States Patent
Ruccolo

(10) Patent No.: US 7,712,622 B2
(45) **Date of Patent: *May 11, 2010**

(54) CHILD'S DRINKING CUP

(76) Inventor: Joseph D. Ruccolo, 125 Country Club Dr., Moorestown, NJ (US) 08057

( * ) Notice: Subject to any disclaimer, the term of this patent is extended or adjusted under 35 U.S.C. 154(b) by 323 days.

This patent is subject to a terminal disclaimer.

(21) Appl. No.: 11/632,240

(22) PCT Filed: Jul. 14, 2005

(86) PCT No.: PCT/US2005/025050

§ 371 (c)(1),
(2), (4) Date: Jan. 11, 2007

(87) PCT Pub. No.: WO2006/019948

PCT Pub. Date: Feb. 23, 2006

(65) Prior Publication Data

US 2007/0235461 A1 Oct. 11, 2007

(51) Int. Cl.
*B65D 21/02* (2006.01)
*B65D 51/16* (2006.01)
*A47G 19/22* (2006.01)

(52) U.S. Cl. ..... 220/23.87; 220/713; 220/717; 220/367.1

(58) Field of Classification Search ..... 220/23.87, 220/713, 718, 719, 731, 717; 215/10; 229/404, 229/906.1
See application file for complete search history.

(56) References Cited

U.S. PATENT DOCUMENTS 608,590 A 8/1898 Freund
1,254,251 A 1/1918 Magnus
2,263,947 A 11/1941 Gottfried
2,414,697 A 1/1947 Petterson
2,534,614 A 12/1950 Michael
3,275,180 A 9/1966 Optner et al.
3,428,214 A 2/1969 De Leon
4,083,467 A 4/1978 Mullins et al.
4,437,576 A 3/1984 Barniak
4,442,948 A 4/1984 Levy et al.
4,582,197 A 4/1986 Lin
5,542,670 A 8/1996 Morano
5,680,951 A 10/1997 Feltman, III et al.
5,772,067 A 6/1998 Morewitz, II
5,890,619 A 4/1999 Belanger
6,640,992 B1 11/2003 Berger et al.
7,210,596 B1 5/2007 Ruccolo

*Primary Examiner*—Anthony Stashick
*Assistant Examiner*—James N Smalley
(74) *Attorney, Agent, or Firm*—Norman E. Lehrer

(57) ABSTRACT

A drinking cup (10, 110) that teaches a child how to drink from a cup while minimizing spills includes an elongated, generally cylindrical housing (12, 112) for holding a liquid (14, 114), the housing (12, 112) has an inside surface (16, 116), an outside surface, and a bottom (20, 120); an elongated, generally cylindrical insert (22, 122) with an inner surface (24, 124) and an outer surface (26, 126) where the insert (22, 122) fits within the housing (12, 112); and a cap (30, 130). The cap (130) may be molded to the insert (122). An annular space (28, 128) is formed between the outer surface (26, 126) of the insert (22, 122) and the inside surface (16, 116) and the bottom (20, 120) of the housing (12, 112). The bottom (123) of the insert (122) may be open and spaced above the bottom (120) of the housing (112). The space (28, 128) receives liquid (14, 114) flowing between the inner surface (24, 124) and the outer surface (26, 126). The cap (30, 130) has a plurality of openings (**36*a*-36*h*, 136*a*-136*f*) formed therein. The openings (36*a*-36*h*, 136*a*-136*f*) are in fluid communication with the space (28, 128) formed between the insert (22, 122) and the housing (12, 112**).

3 Claims, 3 Drawing Sheets

CHILD'S DRINKING CUP

TECHNICAL FIELD

The present invention is directed toward a drinking cup and more particularly, toward a drinking cup that teaches a child how to drink properly from a cup without spilling the contents thereof.

BACKGROUND ART

When first learning how to drink from a cup, toddlers begin by continuing to use the sucking action they associate with a nipple. Toddler cups are available and are often referred to as "sippy" cups. These cups generally have a lid with a spout extending upwardly therefrom. They also frequently have some type of valve mechanism associated with the cup that is in fluid communication with the inside of the cup and prevents the child from spilling the liquid contained within the cup when the cup is inverted or is horizontal. The child must suck on the spout in order to obtain any of the liquid contained within the cup. While such cups aid the child in moving forward in his or her development toward using a cup from which to drink, these cups do not aid a child to develop the ability to drink from a typical cup, that is, a cup that does not require a sucking action.

In the next stage of the child's development, he or she begins to learn how to drink from a cup without using a sucking action. U.S. Pat. No. 6,640,992 to Berger et al. discloses a tumbler that seeks to aid a child to use a cup without the sucking action and helps to limit spills. The tumbler includes a recessed lid and an opening formed between the lid and the rim of the tumbler. In order to use the device, a child must place his or her mouth directly over the opening. Should the child place his or her mouth over any other portion of the rim of the tumbler, liquid will spill out of the opening and the child will not be able to drink.

Therefore, a need exists for a drinking cup that may be used by a child that will teach the child to drink properly from a cup without using a sucking action and that will help to prevent spills while allowing the child to drink freely from the cup.

DISCLOSURE OF THE INVENTION

The present invention is designed to overcome the deficiencies of the prior art discussed above. It is an object of the present invention to provide a drinking cup that teaches a child how to drink properly from a cup.

It is another object of the present invention is to provide a drinking cup that prevents spills while teaching a child to drink from the cup.

In accordance with the illustrative embodiments demonstrating features and advantages of the present invention, there is provided a drinking cup that includes an elongated, generally cylindrical housing for holding a liquid. The housing has an inside surface, an outside surface, and a bottom. Also included is an elongated, generally cylindrical insert with an inner surface and an outer surface where the insert fits within the housing and has means for providing an annular space between the outer surface of the insert and the inside surface and the bottom of the housing. The cup further includes a cap removably mounted to the housing. The annular space receives any liquid flowing between the inner surface of the insert and the outer surface of the insert. The cap has a recessed bottom within which a plurality of openings are formed. The openings are in fluid communication with the annular space formed between the insert and the housing. The space providing means of the insert includes a plurality of tabs located on the outer surface of the insert and a plurality of feet extending downwardly from the bottom of the insert. The cap may be removably mounted to the housing by screw threads formed on the cap and the housing.

In a second embodiment, the cap and the insert may be molded as one piece and the inner surface of the insert tapers. An annular space is formed between the outer surface of the insert and the inside surface and the bottom of the housing. The bottom of the insert is open and is spaced above the bottom of the housing allowing fluid to flow into the annular space. Screw threads are located adjacent the top of the insert that mate with screw thread formed adjacent the top of the housing. Openings are located in the cap as in the first embodiment so that the cup may be used in the same manner.

Other objects, features, and advantages of the invention will be readily apparent from the following detailed description of the preferred embodiments thereof taken in conjunction with the drawings.

BRIEF DESCRIPTION OF THE DRAWINGS

For the purpose of illustrating the invention, there is shown in the accompanying drawings forms that are presently preferred; it being understood that the invention is not intended to be limited to the precise arrangements and instrumentalities shown.

BEST MODE FOR CARRYING OUT THE INVENTION

Figure 1:
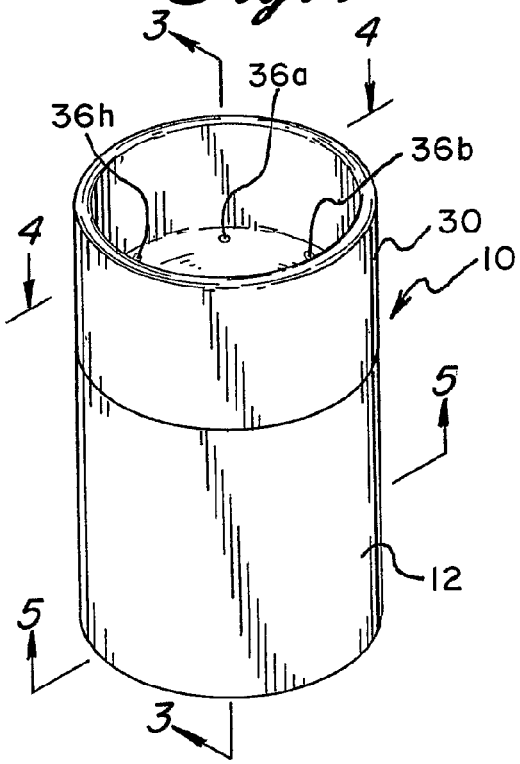
FIG. 1 is a top front perspective view of the cup of the present invention in a fully assembled form.

Referring now to the drawings in detail wherein like reference numerals have been used throughout the various figures to designate like elements, there is shown in FIG. 1 a drinking cup constructed in accordance with the principles of the present invention and designated generally as 10.

The cup 10 of the present invention essentially includes three main parts. The first is an elongated, generally cylindrical outer housing 12 for holding a liquid 14, the housing 12 has an inside surface 16, an outside surface 18, and a bottom 20. The cup 10 further includes an elongated, generally cylindrical insert 22 with an inner surface or wall 24 and an outer surface or wall 26 where the insert 22 fits within the housing 12. The insert 22 is slightly smaller in diameter than the outer housing 12 so as to provide an annular space 28 between the outer surface 26 of the insert 22 and the inside surface 16 of the outer housing 12. In addition, the main portion of the insert 22 is slightly shorter than the outer housing so that the bottom edge of the insert 22 is slightly above the bottom wall 20 of the housing and a space is left therebetween. The third main component of the cup 10 is a cap 30 which is removably mounted to the housing 12. (See FIG. 3.)

Figure 2:
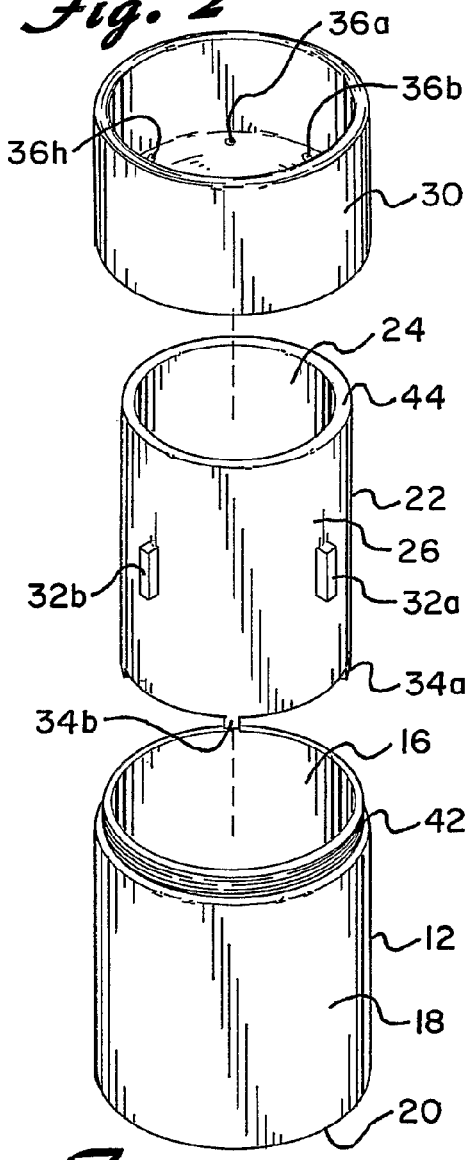
FIG. 2 is an exploded perspective view of the cup of the present invention.
Figure 7:
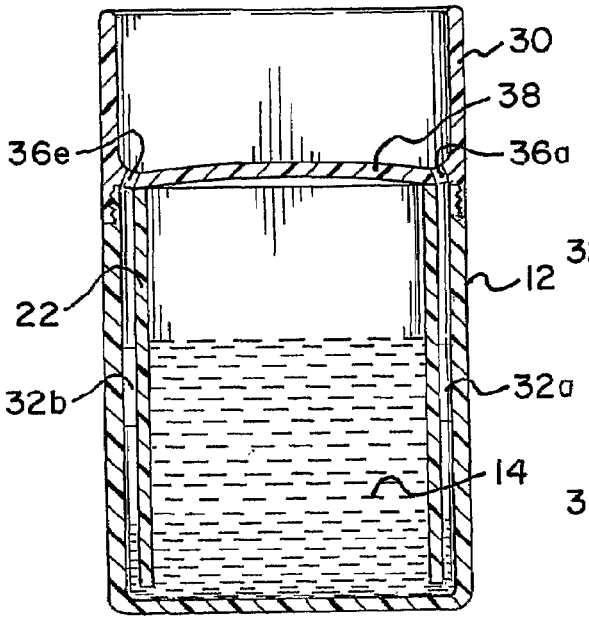
FIG. 7 is a cross-sectional view of the cup of the present invention similar to FIG. 3 but with liquid therein.

In order to maintain the space 28 between the insert 22 and the housing 12, the insert 22 is provided with a plurality of tabs 32*a* and 32*b*, for example, located on the outer surface 26 of the insert 22. The insert 22 also includes a plurality of feet 34*a* and 34*b*, for example, extending downwardly from the bottom of the insert 22. (See FIG. 2.) These feet maintain the space between the main portion of the insert 22 and the bottom wall 20 of the housing 12. When the insert 22 is placed within the housing 12 the tabs 32*a* and 32*b* and feet 34*a* and 34*b* allow for fluid communication between the insert 22 and the housing 12. (See FIG. 7.) The annular space 28 receives any liquid flowing between the inner surface 24, or the inside, of the insert 22 and the outer surface 26, or the outside, of the insert 22.

Figure 3:
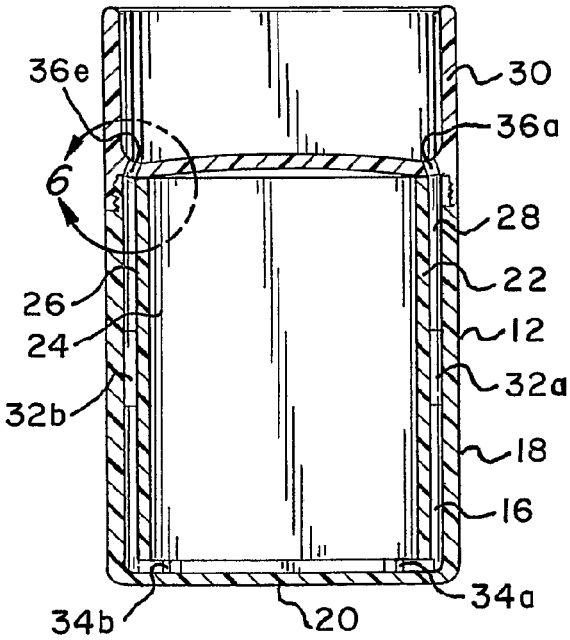
FIG. 3 is a cross-sectional view of the cup of the present invention taken through line 3-3 of FIG. 1.
Figure 4:
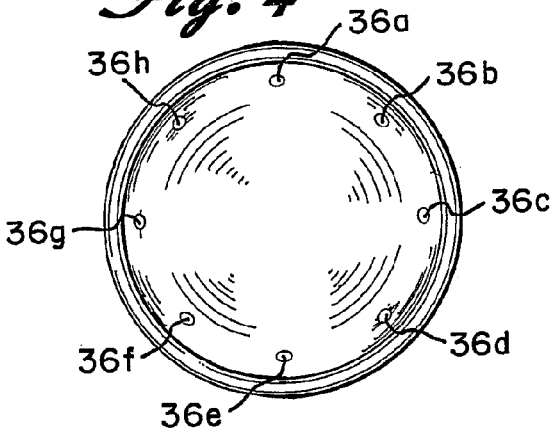
FIG. 4 is a top plan view of the cup of the present invention taken through line 4-4 of FIG. 1.
Figure 5:
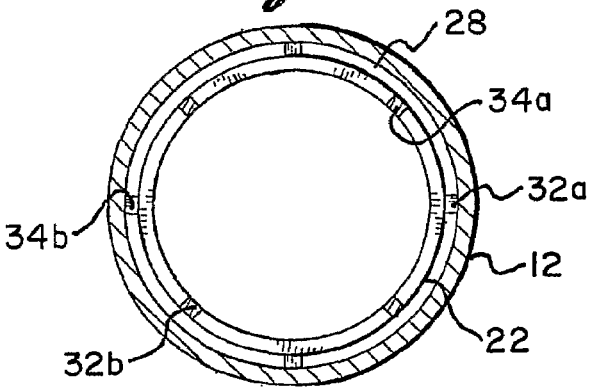
FIG. 5 is a cross-sectional view of the cup of the present invention taken through line 5-5 of FIG. 1.
Figure 6:
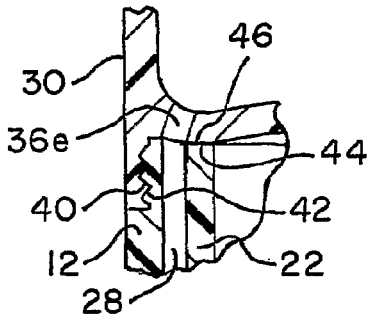
FIG. 6 is a partial cross-sectional view of the cup of the present invention taken through line 6-6 of FIG. 3.

The cap 30 has a plurality of openings 36*a*-36*h* formed around the periphery of the bottom wall 38 of the cap 30. The openings are in fluid communication with the annular space 28 formed between the insert 22 and the housing 12. (See FIG. 4.) The cap 30 is removably mounted to the housing 12 by means of screw threads 40, for example, formed on the cap 30 and complementary screw threads 42 formed on the housing 12. (See FIG. 6.) As best seen in FIGS. 3 and 6, the upper edge 44 of the insert 22 seals against the bottom surface 46 of the cap wall 38 when the cap is screwed into place.

Figure 8:
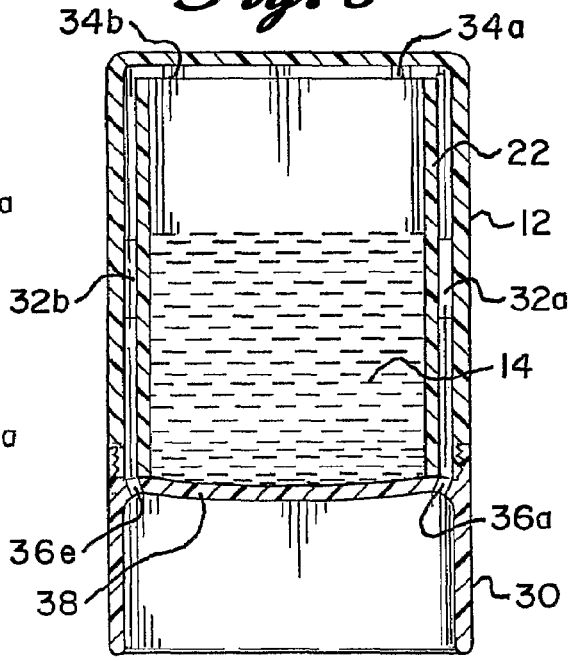
FIG. 8 is a cross-sectional view of the cup of the present invention similar to FIG. 7 but showing the cup in an inverted position.
Figure 9:
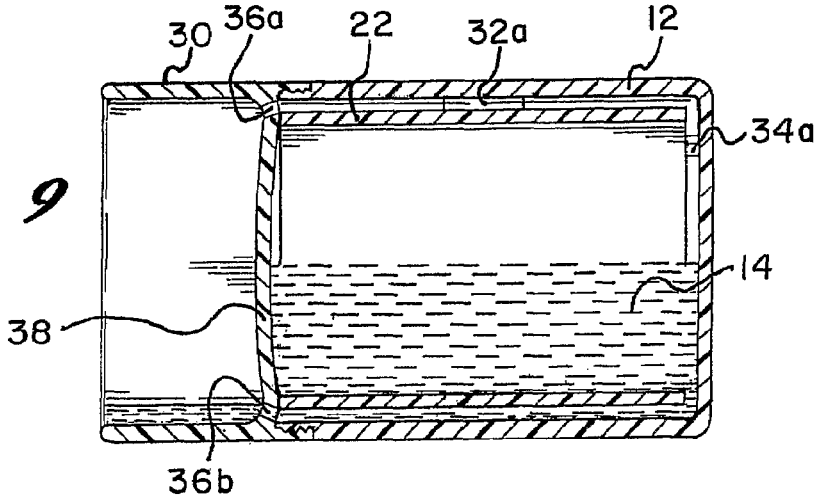
FIG. 9 is a cross-sectional view of the cup of the present invention similar to FIGS. 7 and 8 but showing the cup in a horizontal position.

In order to use the drinking cup of the present invention, the cap 30 is removed from the housing 12 and liquid 14 is poured into the cup. The cap 30 may then be replaced onto the housing 12 and secured thereto. When a child desires to drink from the cup, he or she must tilt the cup onto its side such as shown in FIG. 9 so that the liquid 14 will flow from the inside surface 24 of the insert 22, through the annular space 28 formed between the insert 22 and the housing 12, through any of the openings located in the cap 30, and into his or her mouth. Obviously, if the child does not tilt the cup enough, the liquid will not flown the cup. Furthermore, if the cup is completely inverted, such as shown in FIG. 8, the small amount of liquid that was in the annular space 28 will exit but flow will then stop as the remaining liquid will simply rest on the inside of the wall 38 of the cap 30 and will remain within the interior of the insert 22.

It should also be noted that the wall 38 of the cap 30 is bowed so as to be higher at the center than at the periphery. As a result, any liquid within the cap 30 that remains after the child drinks flows back down through the holes 36*a*-*h* into the annular space 28.

Figure 10:
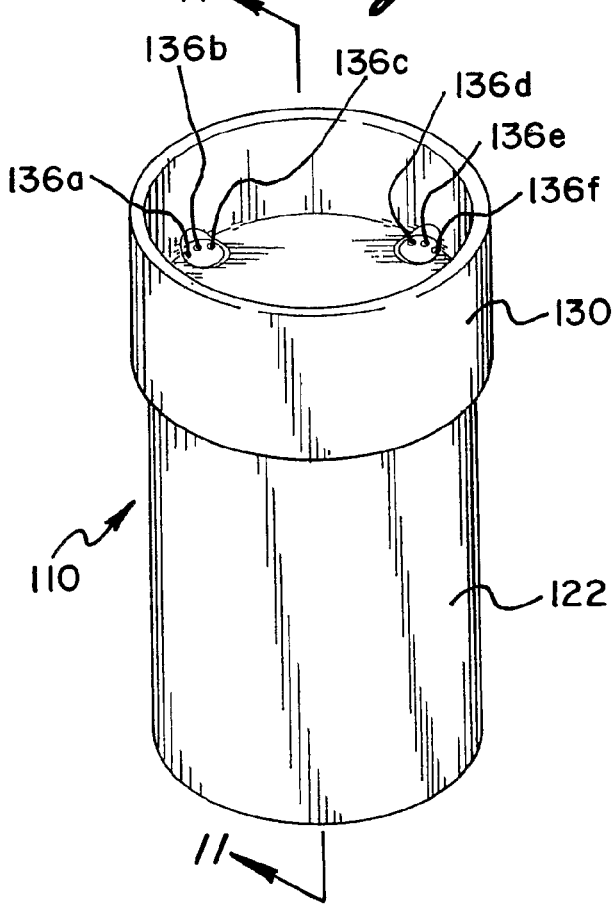
FIG. 10 is a front perspective view of a portion of a second embodiment of the present invention.
Figure 11:
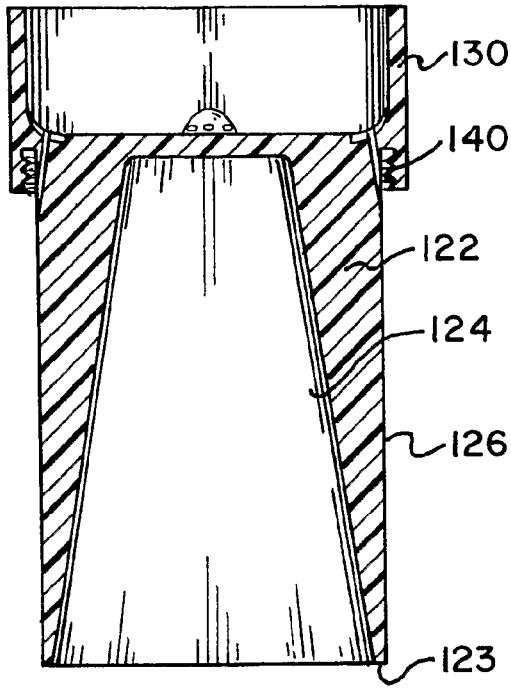
FIG. 11 is a cross-sectional view taken through line 11-11 of FIG. 10.
Figure 12:
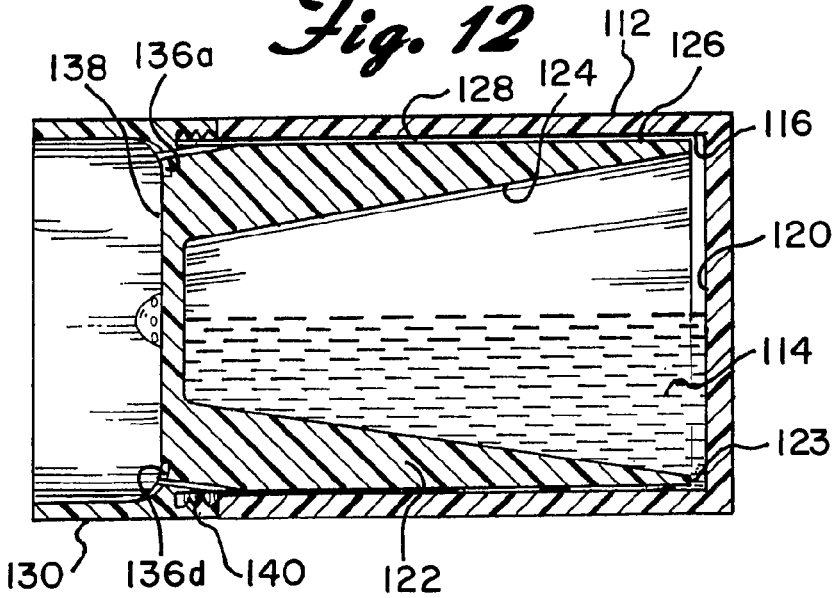
FIG. 12 is cross-sectional view of the cup of the second embodiment of the present invention in a horizontal position.

A second embodiment of the present invention is shown in FIGS. 10-12. The cup 110 of the second embodiment functions in a manner similar to the cup of the first embodiment but differs as discussed below.

In this embodiment the cap 130 and the insert 122 may be molded as one piece. An annular space 128 is formed between the outer surface 126 of the insert 122 and the inside surface 116 of the housing 112. The bottom 123 of the insert 122 is open and is spaced above the bottom 120 of the housing 112 creating an opening into the annular space 128. (See FIG. 12.) To aid in the flow of liquid toward the bottom of the insert and into the annular space, the inner surface 124 of the insert 122 is tapered. (See FIG. 11.) Screw threads 140 are located on the cap 130 adjacent the top of the insert 122 that mate with screw threads formed adjacent the top of the housing 112. The cap 130 and insert 122 are removably mounted to the housing 112 by means of the screw threads.

In this embodiment as in the first embodiment, the cap 130 has a plurality of openings 136*a*-136*f* formed around the periphery of the bottom wall 138 of the cap 130. (See FIG. 10.) The openings are in fluid communication with the annular space 128 formed between the insert 122 and the housing 112. (See FIG. 12.)

In order to use the drinking cup, the cap 130 and insert 122 are removed from the housing 112 and liquid 114 is poured into the cup. The cap 130 and insert 122 are then replaced onto the housing 112 and secured thereto. When a child desires to drink from the cup, he or she must tilt the cup onto its side such as shown in FIG. 12 so that the liquid 114 will flow from the inner surface 124 of the insert 122, through the annular space 128 formed between the insert 122 and the housing 112, through any of the openings located in the cap 130, and into his or her mouth. If the child does not tilt the cup enough, the liquid will not flown the cup. Furthermore, if the cup is completely inverted, the small amount of liquid that was in the annular space 128 will exit but flow will then stop as the remaining liquid will simply rest on the inside of the wall 138 of the cap 130 and will remain within the interior of the insert 122. As a result, the child learns to hold the cup at the appropriate angle for liquid to properly flow.

The present invention allows a child to learn how to drink from a cup without spilling and without using a sucking action. Also, if the cup is inadvertently inverted, minimal spillage will occur. The present invention allows a child to develop a real sense of drinking from a cup.

The present invention may be embodied in other specific forms without departing from the spirit or essential attributes thereof and accordingly, reference should be made to the appended claims rather than to the foregoing specification as indicating the scope of the invention. By way of example and not limitation, the cap, "insert" and the major portion of the housing can be molded or otherwise formed as one piece. With such an arrangement, the bottom wall of the housing could then be removable in order to fill the cup with liquid.

The invention claimed is:

1. A drinking cup that teaches a child how to drink from a cup without undue spilling comprising:

a generally cylindrical housing for holding a liquid, said housing having an inside surface, an outside surface, and a bottom;

an elongated, generally cylindrical insert with an inner surface and an outer surface, said insert fitting within said housing while leaving a substantially annular space between said outer surface of said insert and said inside surface and said bottom of said housing, said space receiving any liquid flowing from the inner surface of said insert; and a cap removably mounted to said housing, said cap having a wall with a center and a periphery, said center being higher than said periphery and a plurality of openings formed within the lower part of said wall adjacent said periphery and substantially equally spaced around said periphery, said openings being in fluid communication with said space formed between said insert and said housing.

2. The drinking cup of claim 1 wherein said cap is removably mounted to said housing by screw threads formed on said cap and said housing.

3. The drinking cup of claim 1 wherein said inner surface of said insert is tapered.

* * * * *